US009095004B2

(12) United States Patent
Lollar

(10) Patent No.: US 9,095,004 B2
(45) Date of Patent: Jul. 28, 2015

(54) INSULATOR FOR OPEN COIL ELECTRICAL RESISTANCE HEATER, HEATER USING SAME, AND METHOD OF USE

(75) Inventor: James Patrick Lollar, Cookeville, TN (US)

(73) Assignee: TUTCO, INC., Cookeville, TN (US)

( * ) Notice: Subject to any disclaimer, the term of this patent is extended or adjusted under 35 U.S.C. 154(b) by 487 days.

(21) Appl. No.: 13/608,181

(22) Filed: Sep. 10, 2012

(65) Prior Publication Data

US 2014/0069911 A1 Mar. 13, 2014

(51) Int. Cl.

| | |
|---|---|
| ***H05B 3/06*** | (2006.01) |
| ***H05B 3/32*** | (2006.01) |
| ***H05B 3/16*** | (2006.01) |

(52) U.S. Cl.

CPC .. *H05B 3/06* (2013.01); *H05B 3/16* (2013.01); *H05B 3/32* (2013.01)

(58) Field of Classification Search

None

See application file for complete search history.

(56) References Cited

U.S. PATENT DOCUMENTS

| | | | | |
|---|---|---|---|---|
| 4,363,959 | A | 12/1982 | Cottrell et al. | |
| 4,531,017 | A | 7/1985 | Sherrill | |
| D285,919 | S * | 9/1986 | Sherrill | D13/131 |
| 4,628,189 | A | 12/1986 | Danko | |
| 4,675,511 | A * | 6/1987 | Sherrill | 219/532 |
| 4,885,840 | A * | 12/1989 | McManus | 29/611 |
| 5,093,558 | A | 3/1992 | Blystone et al. | |
| 5,124,534 | A * | 6/1992 | Williams et al. | 219/532 |
| 5,329,098 | A * | 7/1994 | Howard et al. | 219/532 |
| 5,954,983 | A | 9/1999 | Holmes | |
| 5,959,254 | A | 9/1999 | Martin | |
| 6,259,070 | B1 * | 7/2001 | Audet | 219/461.1 |
| 6,285,013 | B1 | 9/2001 | Holmes | |
| 6,509,554 | B2 * | 1/2003 | Howard et al. | 219/536 |
| 2004/0040947 | A1 * | 3/2004 | Cho et al. | 219/221 |

FOREIGN PATENT DOCUMENTS

| | | |
|---|---|---|
| CN | 101636003 | 1/2010 |
| GB | 2 141 009 | 12/1984 |

* cited by examiner

*Primary Examiner* — Joseph M Pelham

(74) *Attorney, Agent, or Firm* — Clark & Brody

(57) ABSTRACT

An open coil electrical resistance heater employs an insulator having a coil convolution engaging portion that is adapted to engage heater coils with small diameters, small wire diameters, and/or small pitches without distorting the coil and compromising heater performance.

8 Claims, 4 Drawing Sheets

INSULATOR FOR OPEN COIL ELECTRICAL RESISTANCE HEATER, HEATER USING SAME, AND METHOD OF USE

FIELD OF THE INVENTION

The present invention is directed to insulators for open coil electrical resistance heaters, and in particular, to insulators adapted to support heater coils having small diameters, small diameter wires, and/or small coil pitches.

BACKGROUND ART

In the prior art, open coil electrical resistance heaters are well known. These heaters employ a heater coil that is suspended or supported for electrical isolation by insulators, with the insulators themselves being supported by structure associated with the resistance heater. There are generally two types of insulators used in these types of heaters. One type is called "point suspension" type insulator, which is configured to engage convolutions of the coils for support. One problem with these types of insulators is that they are not adapted to easily support and engage coils with small diameters, small wire diameters, and/or small coil pitches (spacing between adjacent convolutions of the heater coil).

Typical prior art insulators are shown in FIG. 1 to illustrate the fit problems when the insulators are used with a small diameter heater coil. The insulators are shown engaging a heater coil with the insulators designated as 1 and 3 and the coil designated as 5. It can be seen in the areas 7 and 9 that the coil convolution spacing Y is severely altered when the insulators 1 and 3 engage the coil 5 and this causes problems over the life of the heater. Insulators like these can be found in U.S. Pat. No. 4,531,017 to Sherrill and U.S. Pat. No. 4,363,959 to Cottrell et al.

This fit problem can be solved using the conventional "string thru" type bushings. These bushings capture the coil by completely or partially surrounding it. One example is shown in FIG. 2, wherein the bushing 11 with its insulator 13 surrounds the coil 5. It can be seen that the coil pitch is not changed between the coil; it merely passes through the opening formed by the bushing. However, these types of insulators are problematic in that the coil 5 does not get full exposure to air flow when the coil 5 is used to heat air for a particular heating application. This is because the insulator 15 has a thickness that necessarily covers part of the coil.

Since heater applications are demanding new heater designs, which include coils with smaller diameters, smaller diameter wires, and smaller pitches, and the prior art insulators are ineffective for these types of heater coils, a need exists for improved insulators. The present invention responds to this need by providing an improved insulator for open coil electrical resistance heaters.

SUMMARY OF THE INVENTION

The invention relates to improvements in the field of point suspension type insulator, and in particular, to an insulator that provides improvements in the field of open coil electrical resistance heaters that happen to use one or more of small diameter coils, small diameter coil wires, and narrow or small pitch coil spacing.

The invention is an insulator that better engages coils with small pitches, small outer diameters, and/or small wires by having unique configuration in terms of how the insulator receives the coil convolutions as part of the engagement process and how the convolutions are held once engaged. The insulator is configured so that the heater coil is not distorted when being held by the insulator, despite the heater coil's small dimensions in terms of coil diameter, wire diameter, and coil spacing.

The insulator is typically for a heater coil in an electrical resistance heater for supporting the heater coil and comprises at least one coil convolution engaging portion and an insulator support portion. The insulator support portion includes a portion configured to engage some structure of the heater to support the insulator so that the insulator can provide electrical isolation between the structure and the heater coil.

The coil convolution engaging portion further comprises a slot having an open end and a slot end face. The slot further comprises a first segment including the open end and sides angled with respect to a longitudinal axis of the insulator and a second segment having opposing parallel sides that terminate at the slot end face, the second segment intended to receive a convolution of the heater coil and retain it therein.

The coil convolution engaging portion includes a pair of convolution guide portions. Each convolution guide portion has an outer end face portion. One end of each outer end face terminates at the open end of the slot. The end face includes an angled portion that extends for at least a distance at an angle with respect to a longitudinal axis of the slot. The outer end face of each guide portion terminates at an edge of an I-shaped coil convolution catch. Each I-shaped coil convolution catch has a first face that extends toward a center of the insulator and a second face that is generally parallel to the parallel sides of the slot and aligned with the longitudinal axis of the insulator. The outer end faces of the convolution guide portions and first and second faces of the I-shaped catches form a split arrow-like shape with the guide portions like the arrow tip and the second faces of the I-shaped catches and the insulator portion therebetween akin to the shaft of the arrow.

The angled end faces of the guide portions are adapted to guide coil convolutions into the I-shaped coil convolution catches, wherein the first face of each I-shaped coil convolution catch is closer to an end of the insulator than the slot end face as measured in a direction parallel to the longitudinal axis of the insulator. When a first coil convolution engages the slot end face, coil convolutions adjacent to the first coil convolution are pinched against the second faces of the I-shaped coil convolution catches and when the coil convolutions adjacent to the first coil convolution engage the first faces of the I-shaped coil convolution catches, the first coil convolution is spaced from the slot end face.

The insulator can have one or a pair of coil convolution engaging portions, depending on the particular heater application.

The shape of the first face of the I-shaped catch can either be a flat surface or one that has a radius or is curved so as to better fit with the round heater coil wire. The slot end face can also be curved or have a radius if so desired.

The invention also entails a method of heating air or other fluid using an open coil electrical resistance heater that includes insulators for supporting heater coils of the heater for at least electrical isolation. The invention provides an improvement to these types of methods by supporting the heater coils of the heater using one or more of the inventive insulators.

The invention is also an improvement in a heater having an open coil electrical resistance heater that includes insulators for supporting heater coils of the heater for at least electrical isolation. The improvement for the heater is the use of one or more of the inventive insulators to support and electrically isolate the heater coils.

DESCRIPTION OF THE PREFERRED EMBODIMENTS OF THE INVENTION

Figure 3A:
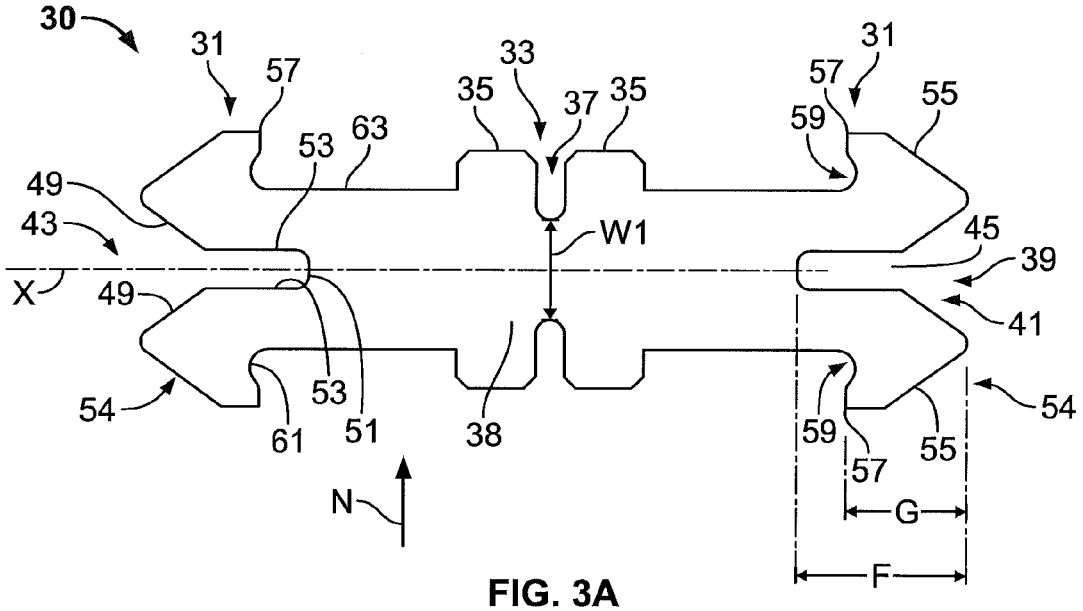
FIG. 3*a* shows a top view of one embodiment of the inventive insulator.
Figure 3B:
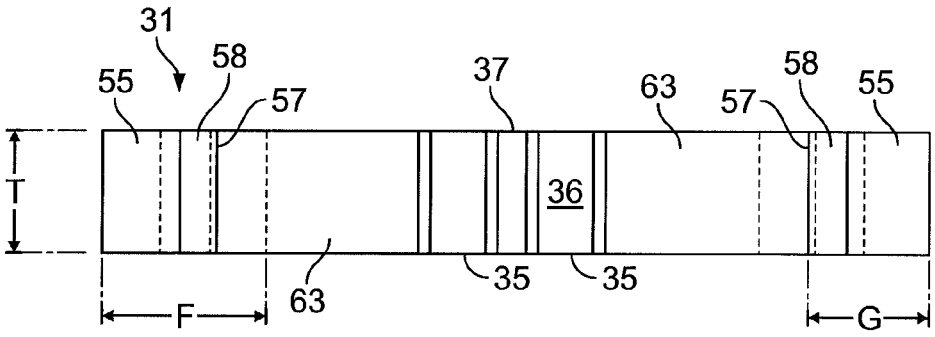
FIG. 3*b* shows an end view of the insulator of FIG. 3*a*.
Figure 3C:
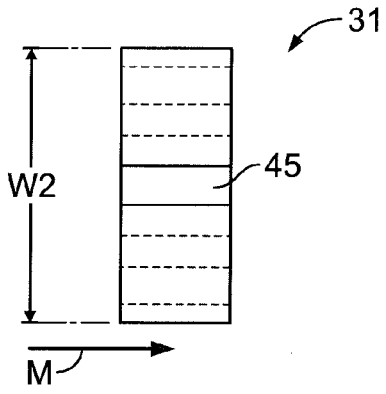
FIG. 3*c* shows a side view of the insulator of FIG. 3*a*.

With reference to FIGS. 3*a*-3*c*, one embodiment of the inventive insulator is designated as reference numeral 30. The insulator has a pair of coil convolution engaging portions 31 with an insulator support portion 33 therebetween.

Figure 4:
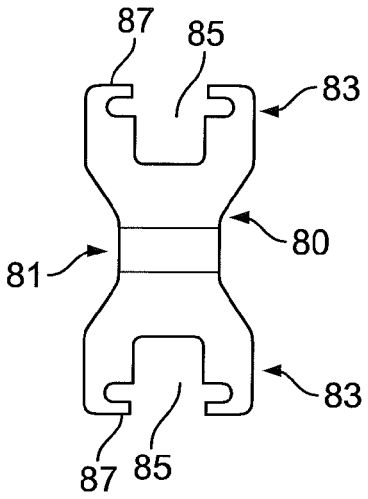
FIG. 4 shows a view of an insulator support clip for use with the inventive insulator.

The insulator support portion 33 is designed to engage a structure of the electrical resistance heater. With this support, the insulator provides electrical isolation for the convolutions of the coil. The insulator support portion is shown a pair of protrusions 35 which form a slot 37. The slots 37 and the width W1 of the insulator support portion 33 are sized to engage a structure or member of the heater to support the insulator. Typically, an insulator support clip is used and the clip is shown in FIG. 4 and designated by the reference numeral 80. The section 81 is intended to be secured to a frame element of the heater for example, by welding or cinching. The clip includes sections 83, each having a recess, each of which being sized to engage the slots 37 of the insulator 30. Tabs 87 are provided that can be bent to span a top surface 36 of the protrusions 35, see FIG. 3*c*, to keep the insulator 30 engaged with the insulator support 80.

It should be understood that the configuration of the insulator support portion 33 and its mounting to a part of a heater is exemplary and other configurations can be employed as a means for supporting the insulator using structure of the open coil electrical resistance heater. For example, instead of protrusions, the body portion 38 of the insulator support portion could have slots recessed therein to engage an insulator support clip. Further, it should be understood that the support clip may also be made of a beam, rod, or wire that is formed to at least partially encircle the insulator and engage the slots recessed for engagement.

Referring again to the inventive insulator, the coil convolution engaging portion 31 includes a slot 39 that includes a first segment 41 having an open end 43 and a second segment 45. The first segment includes a pair of opposing sides 49 that are angled with respect to a longitudinal axis X of the insulator 30. While the angle can vary, an exemplary one would be 37° C. as measured from the longitudinal axis X of the insulator 30. The first segment is v-shaped. What this means is that instead of using the coil convolution intended to reside in the slot 39, adjacent coil convolutions first engage the insulator and assist initially in the engagement of the insulator with the heater coil.

The slot 39 terminates in an end face 51, which can be flat or have a curve or radius to better receive a round coil wire. The second segment 45 of the slot includes opposing and parallel side faces 53, which guide the coil wire as it travels in the slot second segment 45.

The coil convolution engaging portion 31 also includes a pair of coil convolution guiding portions with each portion 54 having a guiding outer end face 55. The outer end face 55 acts as a guide for travel of the coil convolutions until the coil is engaged with the insulator. The faces 55 are shown with an angled segment 56 and a segment 58 that is parallel to the insulator longitudinal axis, with the outer end face 55 terminating at an edge 57 of an I-shaped latch 59. In this configuration, the angled segment 56 pushes the coil convolution far enough from its at-rest state so that it can then follow a straight path along segment 58 until it rests in the I-shaped catch. Pushing the coil further from its at rest state only stresses the coil and accomplishes no purpose since the coil convolution is pushed far enough for engagement with the I-shaped catch. Of course, the outer end face 55, which acts as a guide for travel of coil convolutions until the coil is engaged with the insulator, could angle entirely from the open end of the slot 39 to the edge 57.

Referring now to the I-shaped catches 59, each catch 59 includes a first face 61, which extends toward the longitudinal axis X of the insulator. The first face terminates at the beginning of a second face 63, which runs generally parallel to the axis X, and extends to the insulator support portion 33. While each of the first and second faces can be flat, the first face can include a curve or radius to better receive the round coil wire.

In an exemplary use and referring to FIGS. 5*a*-5*d*, the end of the coil convolution engaging portion 31 of the insulator 30 engages with three convolutions A, B, and C of a heater coil. As the insulator 30 travels toward the interior of the heater coil in direction W, convolution A travels into the first segment 41 of the slot 39, with the convolutions B and C first engaging the angled end faces 56, see FIG. 5*b*.

As the coil convolution engaging portion 31 continues to travel, the convolution A continues to travel in slot 39, ultimately reaching the second segment 45. At the same time, convolutions B and C are urged away from convolution A (the spacing between C and A and B and A increases as compared to the configuration of FIG. 5*a*) and the convolutions continue to travel along the end faces 56.

Figure 5A:
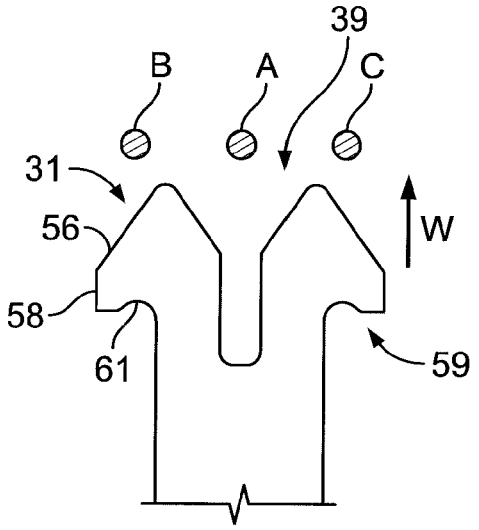
FIG. 5 shows the insulator of FIG. 3*a* in an exemplary use with a heater coil.
Figure 5B:
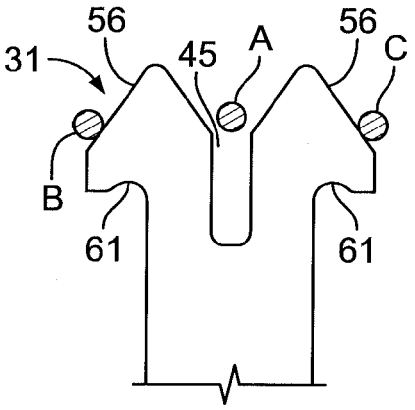
Figure 5C:
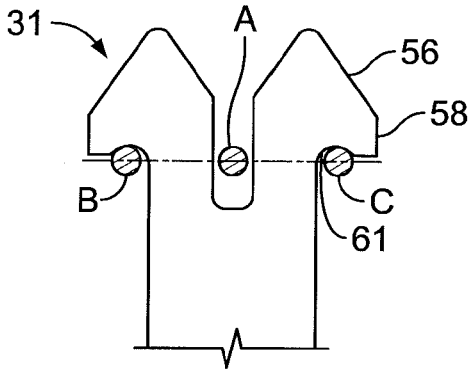

Referring now to FIG. 5*c*, after further travel of the insulator 30 toward the interior of the heater, the convolutions B and C pass over the edges 57 of the outer end faces 55 and then engage the first faces 61 of the I-shaped catches 59. Once the convolutions B and C engage the first faces 61, the insulator 30 is securely linked to the coil convolutions. The spring nature of the heater coil provides a compressive force, whereby convolutions B and C are urged against the second faces 63 of the I-shaped catches 59. This prevents the convolutions from disengaging with the insulator 30.

Referring again to FIG. 5C, with the convolutions B and C in place, convolution A rests between the parallel side faces 53 of the slot segment 45 and is spaced from the end face 51 of the slot segment 45. This is a result of the spacing difference as measured in a direction parallel to the longitudinal axis of the insulator for the insulator between the end face 51 of the slot and the first faces 61 of the I-shaped catches 59. This spacing difference can be seen in FIG. 3*a*, wherein the slot end face 51 is at a distance F from the end of the insulator, and the faces 61 of the catches 59 are at a spacing G from the end of the insulator, with F being greater than G. This results in the configuration shown in FIG. 5*c*, wherein when the convolutions B and C rest in the catches 59, the convolution A sits between side faces 53 of the slot segment 45 but does not engage the slot end face 51.

Figure 5D:
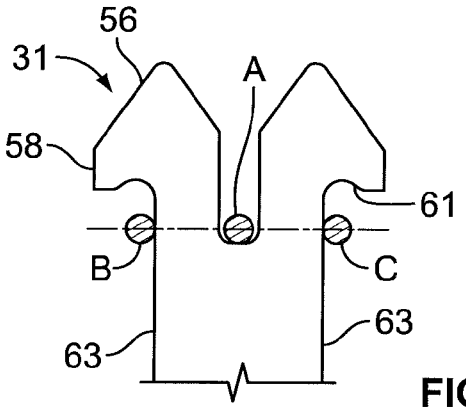

With reference to FIG. 5*d*, because of the spacing difference between the faces 61 and end face 51, when the convolution A rests in the end face 51, the convolutions B and C will rest against the second faces 63. The insulator, by virtue of the I-shaped catches 59 still prevents the convolutions B and C from being disengaged from the coil convolution engaging portion 31 and the coils are still effectively supported using the insulator.

Figure 6:
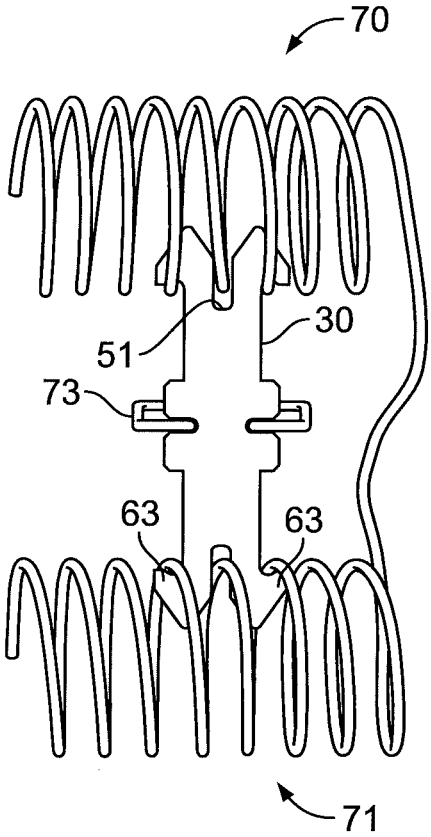
FIG. 6 shows an inventive insulator supporting a pair of coils.

The configuration of FIG. 5*d* may be found when the insulator 30 is used to support a heater coil, with the insulator 30 positioned vertically between two heater coils, an upper coil and a lower coil, for support. FIG. 6 shows an insulator 30 supporting two coils 70 and 71 and an insulator support clip 73 in this manner. The convolution of coil 70 entering the slot 39 rests on the end face 51 due to gravity. The coil convolutions B and C are pinched against the second faces 63 of the I-shaped catches 59 and spaced from the first faces 61 of the I-shaped catches 59, see FIG. 5*d*.

When the coil 71 is engaged with the other coil convolution engaging portion 31, the coil convolutions B and C would rest on the first faces 61 of the I-shaped catches 59 due to gravity, the convolution A would be spaced from the slot end face 51 as shown in FIG. 5*c*.

It should be understood that the insulator can use only one coil convolution engaging portion 31. That is, instead of providing support for two heater coils as shown in FIG. 6, only one heater coil would be supported.

With reference back to FIGS. 3*a* and 3*b*, it should be noted that the overall width W2 of the insulator 30 is not greatly different from the thickness T. For example, the width between the second faces 63 could be 0.250 inches, the width of the coil convolution engaging portions could be 0.50 inches. The thickness T could be around 0.20 inches. As a result of the relatively small difference in the dimensions of the width and thickness of the insulator, the insulator 30 can be oriented in a heater in different configurations without an adverse affect on airflow passing over the coils. That is, the air flow could be going in the direction M shown in FIG. 3*c*, which would be across the width of the insulator. On the other hand, the insulator 30 could be turned so that the air flow is in direction N, see FIG. 3*a*, which is against the thickness. The relatively small difference in dimensions for the thickness and width allows the insulator to be more easily positioned in a given heater application without having to be used in only one position because changing the position would affect the airflow. With the inventive insulator, more freedom is provided as to how the insulator can be positioned without severely disrupting the air flow across the coils of the heater. This flexibility also allows the insulator 30 to be positioned so that either the width part, the thickness part, or a combination of the two would be facing the air flow, still with minimal disruption to the similarity in dimensions for the thickness T and width W2.

Figure 1:
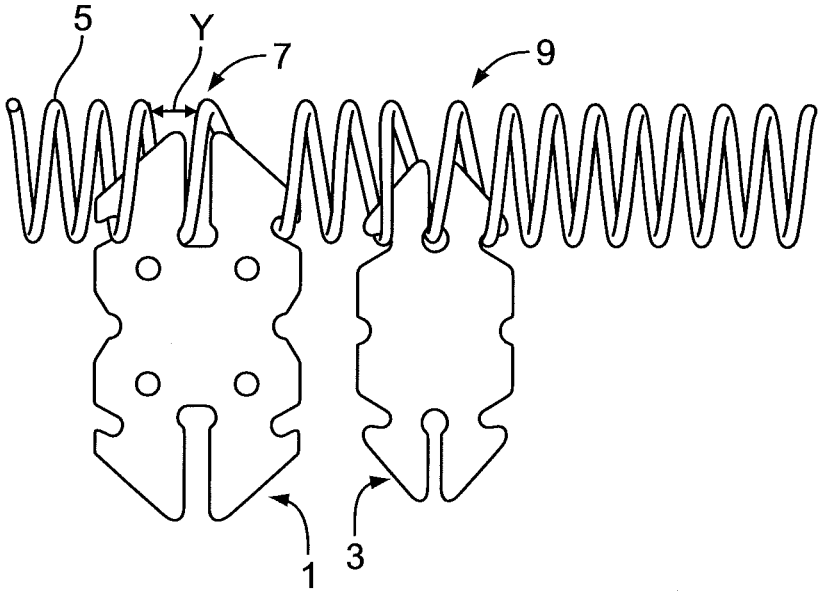
FIG. 1 shows prior art point suspension type insulators supporting a heater coil.
Figure 2:
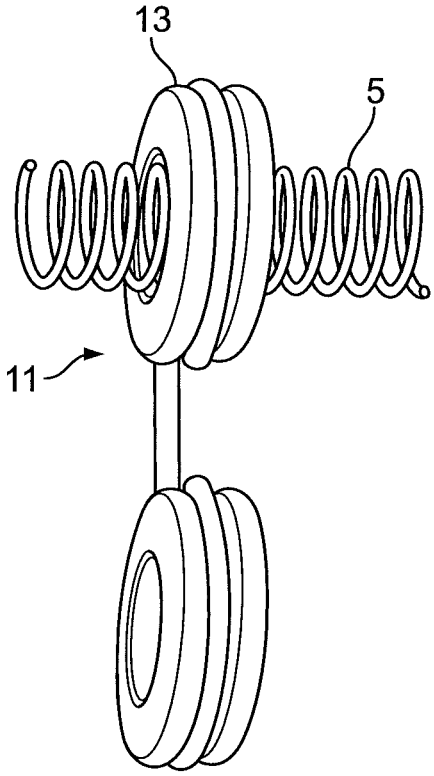
FIG. 2 shows a prior art string-thru type bushing supporting a heater coil.

In the embodiment of FIGS. 3*a*-3*c*, the width of the insulator between the second faces 63 is designed to generally match the spacing between coil convolutions B and C, with the slot 39 bisecting this width so that the space between the slot 39 and I-shaped catch 59 generally matches the spacing between convolutions A and C or A and B. By providing an insulator of narrow dimensions for the I-shaped catches and slot, the insulator can effectively engage a heater coil with narrow or small pitches and small diameter. The width of the slot 39 can be reduced in segment 45 to accommodate small diameter wires. In this way, the distortion in the heater coil shown in FIG. 1 is avoided.

The insulator can be made out of any known insulating material that is commonly employed in the prior art insulators now existing.

The insulator of the invention can be used in any application where a heater coil or coils must be supported to provide electrical isolation between the heater coil and any surrounding structure of an electrical resistance heater that may cause an electrical short. Since the types of open coil heaters are well known in the prior art, a further explanation of their features, i.e., the frame structure, thermostats or other heater components, a further description of these heater components and features is not deemed necessary for understanding of the invention.

Thus, the insulator can be used in a method of heating a fluid such as air wherein the air is drawn or forced across the heater coils for heating purposes.

The inventive heater insulator has a number of unique features that provides a significant improvement over the insulators of the prior art. These features include:

- the ability to use small diameter coil wires effectively as compared to prior art insulators;
- the ability to effectively support small outer diameter heater coils;
- the ability to avoid the loss of radiant heat typically occurring with the use of string-thru bushings, while still accommodating small diameter heater coils, small diameter coil wires, and/or small coil pitches;
- the ability to have an insulator with only one coil convolution engaging portion, thus reducing the footprint and area required to mount and heat; and
- the similarity between the insulator width and thickness means that the insulator can be used with either its thickness side, its width side, or a combination thereof in the heating fluid path without much affect on airflow.

As such, an invention has been disclosed in terms of preferred embodiments thereof which fulfills each and every one of the objects of the present invention as set forth above and provides a new and improved insulator for open coil electrical resistance heaters and their methods of use.

Of course, various changes, modifications and alterations from the teachings of the present invention may be contemplated by those skilled in the art without departing from the intended spirit and scope thereof. It is intended that the present invention only be limited by the terms of the appended claim

I claim:

1. An insulator for a heater coil in an electrical resistance heater for supporting the heater coil comprising:

at least one coil convolution engaging portion; and an insulator support portion, the insulator support portion including a portion configured to engage structure of the electrical resistance heater so that the insulator provides electrical isolation between the structure and the heater coil, the at least one coil convolution engaging portion further comprising:

a slot having an open end and a slot end face, the slot further comprising a first segment including the open end and sides angled with respect to a longitudinal axis of the insulator and a second segment having opposing parallel sides that terminate at the slot end face, a pair of convolution guide portions, each convolution guide portion having an outer end face that has at least an angled portion, one end of the outer end face terminating at the open end of the slot and the other end of the outer end face terminating at an edge of an I-shaped coil convolution catch, each I-shaped coil convolution catch having a first face extending towards the longitudinal axis of the insulator and a second face that is generally aligned with the longitudinal axis of the insulator, the outer end faces adapted to guide coil convolutions into the I-shaped coil convolution catches, wherein the first face of each I-shaped coil convolution catch is spaced a distance from the open end of the insulator in a direction parallel to the longitudinal axis of the insulator, said distance being less than a distance between the slot end face and the open end of the insulator, as measured in a direction parallel to the longitudinal axis of the insulator, wherein when a first coil convolution engages the slot end face, adjacent coil convolutions are pinched against the second faces of the I-shaped coil convolution catches and when the adjacent coil convolutions engage the first faces of the I-shaped coil convolution catches, the first coil convolution is spaced from the slot end face.

2. The insulator of claim 1, further comprising a pair of coil convolution engaging portions with the insulator support portion between the pair.

3. The insulator of claim 1, wherein the first face of each of the I-shaped catches is curved.

4. The insulator of claim 2, wherein the first face of each the I-shaped catches is curved.

5. The insulator of claim 1, wherein the slot end face is curved.

6. The insulator of claim 2, wherein the slot end face is curved.

7. In a method of heating a fluid such as air using an open coil electrical resistance heater that includes insulators for supporting heater coils of the heater for at least electrical isolation, the improvement comprising supporting the heater coils using at least one insulator according to claim 1.

8. In a heater having an open coil electrical resistance heater that includes insulators for supporting heater coils of the heater for at least electrical isolation, the improvement comprising at least one insulator according to claim 1.

* * * * *